US005897444A

United States Patent [19]

Hellyer

[11] Patent Number: 5,897,444

[45] Date of Patent: Apr. 27, 1999

[54] BALL SUPPORT BATTING TEE

[76] Inventor: Kenneth E. Hellyer, 11724 Monte Vista Dr., Whittier, Calif. 90601

[21] Appl. No.: 08/885,627

[22] Filed: Jun. 30, 1997

Related U.S. Application Data

[63] Continuation of application No. 08/661,007, Jun. 10, 1996, abandoned.

[51] Int. Cl.[6] ..... A63B 69/40

[52] U.S. Cl. ..... 473/417

[58] Field of Search ..... 473/422, 423, 473/417

[56] References Cited

U.S. PATENT DOCUMENTS

| | | | |
|---|---|---|---|
| 2,616,692 | 11/1952 | Bird | 473/417 |
| 3,762,705 | 10/1973 | Gonzalez | 276/26 R |
| 5,076,580 | 12/1991 | Lang | 273/26 R |
| 5,320,343 | 6/1994 | McKinney | 473/417 |
| 5,386,987 | 2/1995 | Rodino | 473/417 |

*Primary Examiner*—Theatrice Brown
*Attorney, Agent, or Firm*—Edgar W. Averill, Jr.

[57] ABSTRACT

An adjustable ball support device for holding a ball stationary in an elevated position in order that the ball may be struck by a bat, club or the like. The device has particular utility for supporting a baseball in a number of positions to enable the ball to be struck by a baseball bat. The ball support device is easily adjustable and is less susceptible to damage than prior devices. The ball support device which is easily assembled and disassembled and is relatively compact when disassembled.

6 Claims, 3 Drawing Sheets

131
130
127
100
125
125A
122
116A
121
120
122B
124
11
116
112
109B
117
108A
109A
115
108
109
117A
112a
114
104
106
107
101
151A
102
151
160

131
130
129
127
128
125
125A
122B
124
121
122
120
115
112
116
116A
112A
114
117
117A
109B
108
108A
109
104
109A
107
160
106
151
151A
175
101
153
102

BALL SUPPORT BATTING TEE

This application is a continuation of application Ser. No. 08/661,007, filed Jun. 10, 1996, now abandoned.

BACKGROUND

1. Field of the Invention

This invention relates, generally, to a new practice batting or hitting device. More particularly, the invention relates to a baseball or softball practice hitting device that is adjustable to provide an almost infinite number of ball positions.

2. Prior Art

In the game of baseball, one of the most difficult skills to master is hitting the pitched baseball. First, a hitter must be able to coordinate the swing of a bat with the location of a ball so that good contact with the ball can be made while swinging the bat. Once this is mastered, the hitter must next learn to make good contact with the ball at the various positions at which it may cross home plate, from an inside pitch to an outside pitch, and from a high pitch to a low pitch, and the various combinations of these two variables.

In the development of these skills, the trainer or coach often uses a baseball tee to support a ball at a selected height above a representation of the baseball home plate. The player then hits the ball. In this manner, the player can practice swinging and improve hand-to-eye coordination. Moreover, the player can develop his/her wrist and arm muscles as well as over all body mechanics.

Various practice batting tees have been developed in the past for this purpose. The practice tees developed to date, however, have had limitations which have discouraged their overall acceptance in the baseball world. In some cases, the tees have been very expensive to produce, and the cost has been prohibitive for many of the smaller teams.

In the past, ball support devices for batting practice and the like, typically, comprise a support post which is adapted to be embedded in the ground or otherwise supported by a base so as to extend vertically upwards. The upper end of the post has a cup or dish-shaped member thereon which provides an upwardly facing concave surface in which the ball to be struck can be located. Devices of this nature are used to play various games and are used as training aids for young players who are not sufficiently well coordinated to play conventional baseball where the ball is thrown towards the batsman.

Prior art devices of this nature have suffered from various disadvantages. One disadvantage concerns the flexibility of the device. Generally, such devices comprise a rigid post which may have the upper end thereof covered by a resilient cover or the like. However, when the cover is struck by a bat a substantial impact force is imparted to the post potentially causing damage to the post or bat and tending to knock the post over.

A further problem with many prior art devices is that they are not adjustable in height, or are only adjustable with difficulty making the device unsuitable for use by a range of sizes of players in the same game.

Another problem with many prior art devices is that they are not easily packaged for sale and transportation. Clearly, if the device is provided with a base which is heavy, or where the device is bulky, transportation costs are increased.

PRIOR ART STATEMENT

The following patents, listed in descending numerical order, were discovered in a preliminary patentability search.

U.S. Pat. No. 5,478,070; BALL AND BAT TRAINER TEE AND GUIDE ASSEMBLY; Morrison. A U-shaped frame with ball supporting blocks at the free ends of the frame through which a bat is swung.

U.S. Pat. No. 5,467,979; BASEBALL BATTING PRACTICE DEVICE; Zarate. A baseball batting practice device with a freely rotating ball supporting rod.

U.S. Pat. No. 5,386,987: TWO-IN-ONE BATTING TEE; Rodino, Jr. A practice tee with a metal tube having a rubber sleeve and a weighted base.

U.S. Pat. No. 5,332,276; BAT SWING GUIDE; Hardison, Jr. A vertical support has an arcuate bat guide attached thereto and a ball supporting tee adjacent the end of the guide.

U.S. Pat. No. 5,203,558; UNIDIRECTIONAL FLEXIBLE SPINNER; An. A hitting training device having a sphere spinably mounted on a flexible structure.

U.S. Pat. No. 5,100,134; BALL SUPPORT DEVICE; Becker. A ball support device with a base, a telescopic post and friction means for fixing the telescopic post position.

U.S. Pat. No. 5,087,039; BASEBALL BAT SWING TRAINING DEVICE; Laseke. A baseball bat swing training device with a U-shaped swing guide.

U.S. Pat. No. 5,076,580; FOOT POSITION TEACHING APPARATUS FOR BATTING PRACTICE; Lang. A ball support pivotally attached to foot alignment devices to teach a batting stance.

U.S. Pat. No. 5,029,852; BAT SWING GUIDE; Gilfillano. A bat swing guide with a horizontal guide, an arcuate guide and a support base.

U.S. Pat. No. 4,993,708; BATTING TEE; Prosser et al. A tee ball stand including a base with a separable ball support member which pivots when struck.

U.S. Pat. No. 4,989,867; DAMPED TENNIS PRACTICE DEVICE; Herrick. A tennis practice device with a ball mounted on a flexible, resilient wand.

U.S. Pat. No. 4,979,741; BATTING TRAINING APPARATUS; Butcher. A flexible ball support with a disc member adjacent to the end of the support.

U.S. Pat. No. 4,938,478; BALL HITTING DEVICE; Lay. A ball hitting practice device comprising a long flexible pedestal attached to a planar base and having a specially molded ball fixed to said pedestal.

U.S. Pat. No. 4,907,801; REBOUND BASEBALL TRAINING APPARATUS; Kopp. A hollow tube receives a rod with a baseball on the end thereof. A coil spring inside the hollow tube causes the rod to rebound after the ball has been struck.

U.S. Pat. No. 4,903,966; DEVICE FOR BATTING AND STRIKING PRACTICE; Lias. A batting and striking device with a base assembly which receives a tube and a sleeve with a height adjusting mechanism.

SUMMARY OF THE INSTANT INVENTION

The new practice hitting device of the present invention broadly comprises in combination a planar base adapted to rest on a solid surface, a vertical support post mounted on the planar base, a vertical pedestal which supports a baseball, softball or the like, at the top thereof and a support apparatus comprised of at least two interconnected arm members adjustable relative to each other and selective positioning means for mounting the arm members in a desired position of adjustment relative to each other as well as to the post and pedestal to thereby provide means for adjusting the height of the pedestal. The pedestal is a tubular ball holder fitted to the upper end of the support apparatus. The pedestal has a flexural rigidity along its length and is slidably mounted on the upper end of the support apparatus. The lower end of the support apparatus is slidably mounted on the post which is connected to the base.

It is an object of the invention, therefore, to provide an adjustable practice hitting device which can be adjusted according to the height of the batter. Also, the device can be adjusted to support a ball in a multitude of locations. It is a further object to provide a new adjustable hitting device which can be produced at low cost and can be made available to all softball and baseball teams. It is a further object to provide a new practice hitting device that can be used indoors as well as outdoors. These and other objects of the invention will be apparent from the following detailed description thereof.

DESCRIPTION OF A PREFERRED EMBODIMENT

Figure 1:
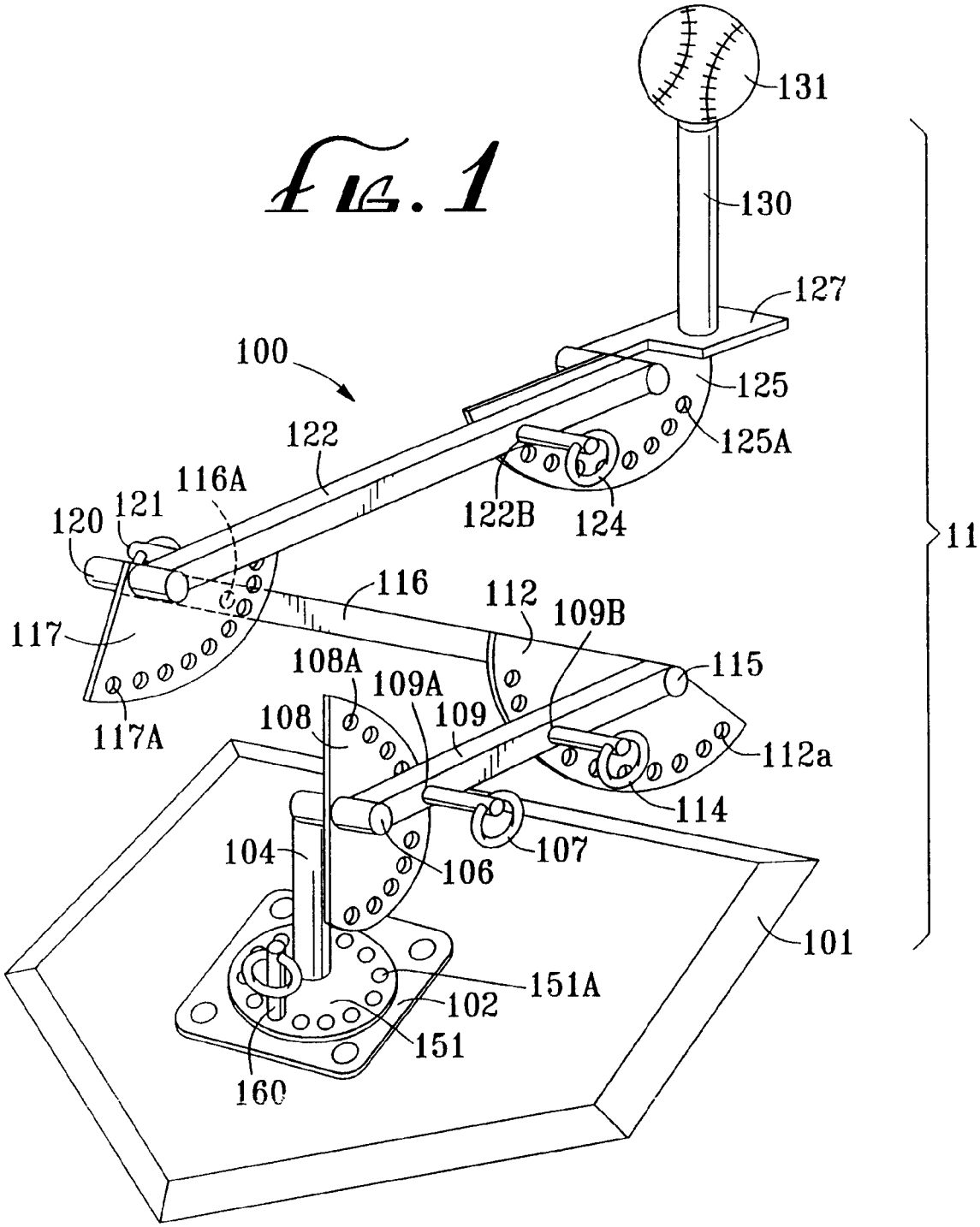
FIG. 1 shows a perspective view of a ball support device according to the invention.
Figure 2:
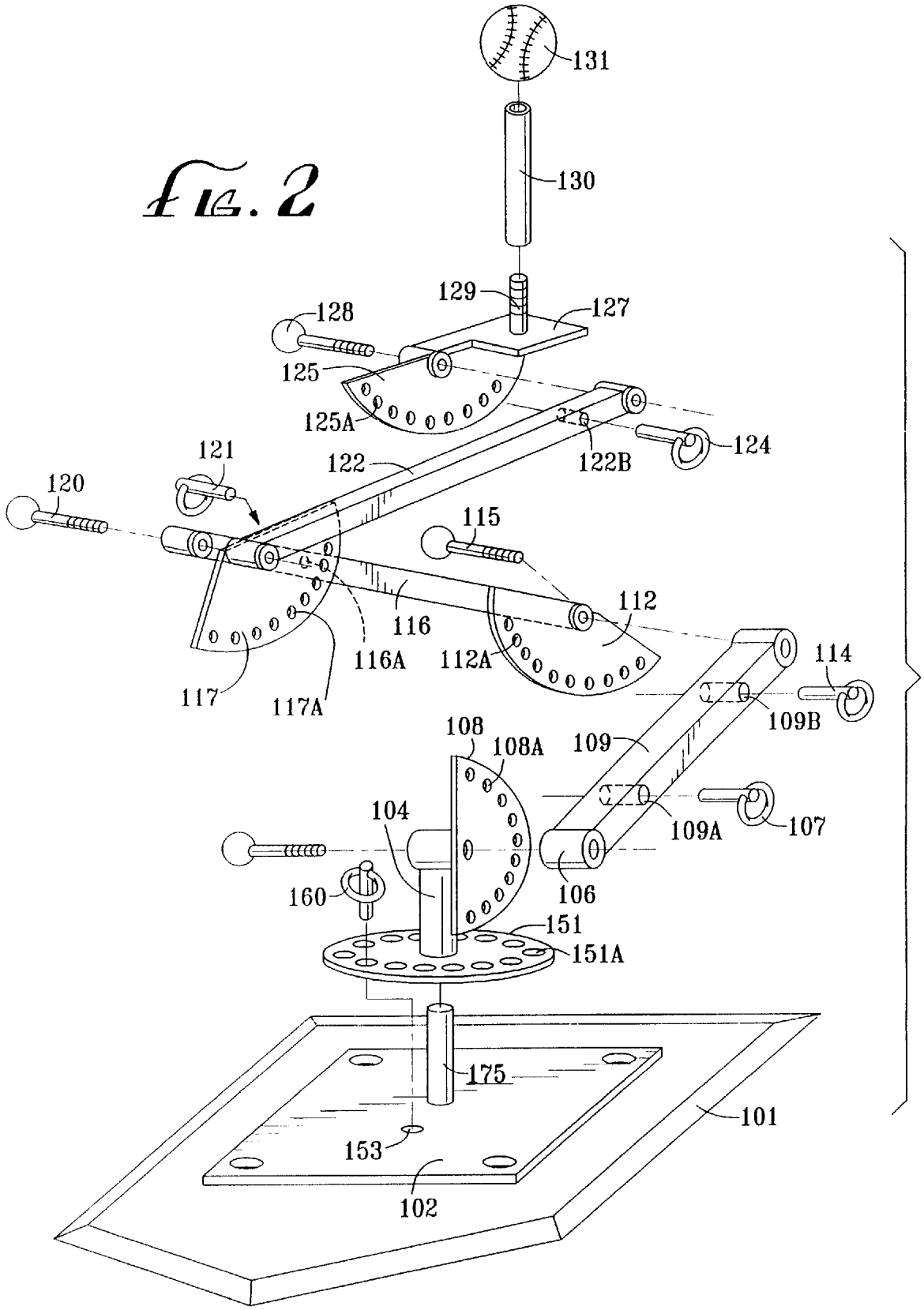
FIG. 2 shows an exploded perspective view of the ball support device of FIG. 1.

Referring now to FIGS. 1 and 2 concurrently, ball support device 100 includes a base 101, an articulated support apparatus 11 and a tubular ball holder 130 fitted to the top of the support. The support apparatus 11 is comprised of a plurality of interconnected arms 109, 116 and 122. A lower tubular shaft 104 is adjustably connected to arm 109. The shaft 104 is, preferably, a close sliding fit with the internal support pin 175 which is attached to mounting plate 102 which is mounted on the support base 101. In a preferred embodiment, support base 101 is configured to resemble "home plate" for batting practice purposes. In one embodiment, the support base is presented in the size and shape of a "regulation" home plate.

The shaft 104 is joined to (or formed with) sprocket 151 which includes a plurality of holes 151A therethrough. The holes 151A cooperate with at least one counterpart hole 153 formed in plate 102 (and base 101 if necessary).

The self-locking release pin 160 is selectively inserted through one of holes 151A into the counterpart hole 153 (or receptacle) in plate 102 (and base 101) to lock the shaft 104 and sprocket 151 in place relative to the base 101. The degree of adjustment is, of course, determined by the number and positioning of holes 151A in sprocket 151.

In like manner, a sprocket 108 is affixed to and rotatable with shaft 104. In this embodiment, sprocket 108 describes an arc of about 180° along a line parallel to the axis of shaft 104. The sprocket 108 is, essentially, centered at the top end of shaft 104. The sprocket 108 includes a plurality of holes 108A therethrough and adjacent to the periphery thereof. The sprocket 108 need not be semi-circular in configuration but this is a preferred shape.

One end of arm 109 is rotatably mounted to the top end of shaft 104 by means of a suitable pin such as a bolt 106. The bolt 106 can be secured in place by a hex nut (not shown) or other suitable locking device. Aperture 109A passes through arm 109 and selectively aligns with one of the holes 108A in sprocket 108. Self-locking release pin 107 is selectively passed through aperture 109A and one of the holes 108A. Thus, arm 109 rotates around pivot bolt 106 and is selectively positioned relative to sprocket 108 and, ultimately, base 101.

The second end of arm 109 is pivotally joined to one end of arm 116 by a pivot bolt 115 which passes through openings at the ends of arms 109 and 116. Sprocket 112 is attached to the end of arm 116 at a 90° angle. Therefore, pivot bolt 115 also passes through a hole in the midpoint of sprocket 112. Sprocket 112 has a plurality of holes 112A arranged at the perimeter thereof. In a preferred embodiment, the edge of sprocket 112 defines an angle of about 135°.

Arm 109 includes an aperture 109B therethrough adjacent the second end thereof. The aperture 109B is selectively aligned with one of the plurality of holes 112A in sprocket 112.

The self-locking release pin 114 is selectively passed through aperture 109B and one of the holes 112A in sprocket 112. The pin 114, thus, locks the arm 109 and sprocket 112 (which is attached to arm 116) in a selected position.

The second end of arm 116 is pivotally joined to one end of arm 122 by a pivot bolt 120 which passes through openings at the ends of arms 116 and 122. Pivot bolt 120 also passes through a hole in the midpoint of sprocket 112. Sprocket 117 is attached to the end of arm 122 substantially parallel to the axis thereof. Therefore, sprocket 117 has a plurality of holes 117A arranged at the perimeter thereof. In a preferred embodiment, the edge of sprocket 112 defines an angle of about 135°.

Arm 122 includes an aperture 122B therethrough adjacent the second end thereof. The aperture 122B is selectively aligned with one of the plurality of holes 125A in sprocket 125.

The self-locking release pin 121 is selectively passed through aperture 116A in arm 116 and one of the holes 117A in sprocket 117. The pin 121, thus, locks the arm 116 and sprocket 117 (which is attached to arm 122) in a selected position.

The second end of arm 122 is pivotally joined to one end of plate 127 by a pivot bolt 128 which passes through openings at the ends of arm 122 and plate 128. Sprocket 125 is attached to the edge of plate 127 at a 90° angle.

Sprocket 125 has a plurality of holes 125A arranged at the perimeter thereof and a mounting hole at about the mid point of the edge thereof. In a preferred embodiment, the edge of sprocket 112 defines an angle of about 180°.

Arm 122 includes an aperture 122B therethrough adjacent the second end thereof. The aperture 122B is selectively aligned with one of the plurality of holes 125A in sprocket 125.

The self-locking release pin 124 is selectively passed through aperture 122B and one of the holes 125A in sprocket 125. The pin 124, thus, locks the arm 122 and sprocket 125 (which is attached to plate 127) in a selected position.

Shaft 129 is formed with or joined to the upper surface of plate 127. The ball holder 130 can take any convenient form but is preferably tubular having an internal diameter which is a snug but sliding fit on the upper tubular member 129. The ball holder pedestal 130 may have an upper surface of concave shape with a radius of curvature suitable to accommodate the ball 131 to be located therein. The flexural rigidity of the ball holder pedestal 130 may vary along its length, preferably being more flexible at the upper end thereof to accommodate the striking thereof by a bat during a practice swing.

The height of the support apparatus can be varied by moving the support arms 109, 116 and 122 relative to each other by adjusting one or more of the adjustable fasteners 108, 112, 117 and/or 125 to thereby decrease or increase the height of the apparatus. The tubular pedestal 130 may be formed of a light-weight plastic material which is sufficiently strong to withstand the rigours of being struck by a bat under normal playing conditions.

The adjustable fasteners 108, 112, 117 and/or 125 preferably include a sprocket defining a portion of an arc with a plurality of apertures therethrough for holding the interconnected arms in any position of adjustment. In addition, each joinder of the arms includes a friction grip means which may take various forms but one convenient form is shown in the form of a thumb screw 106, 120 or 128.

Figure 3:
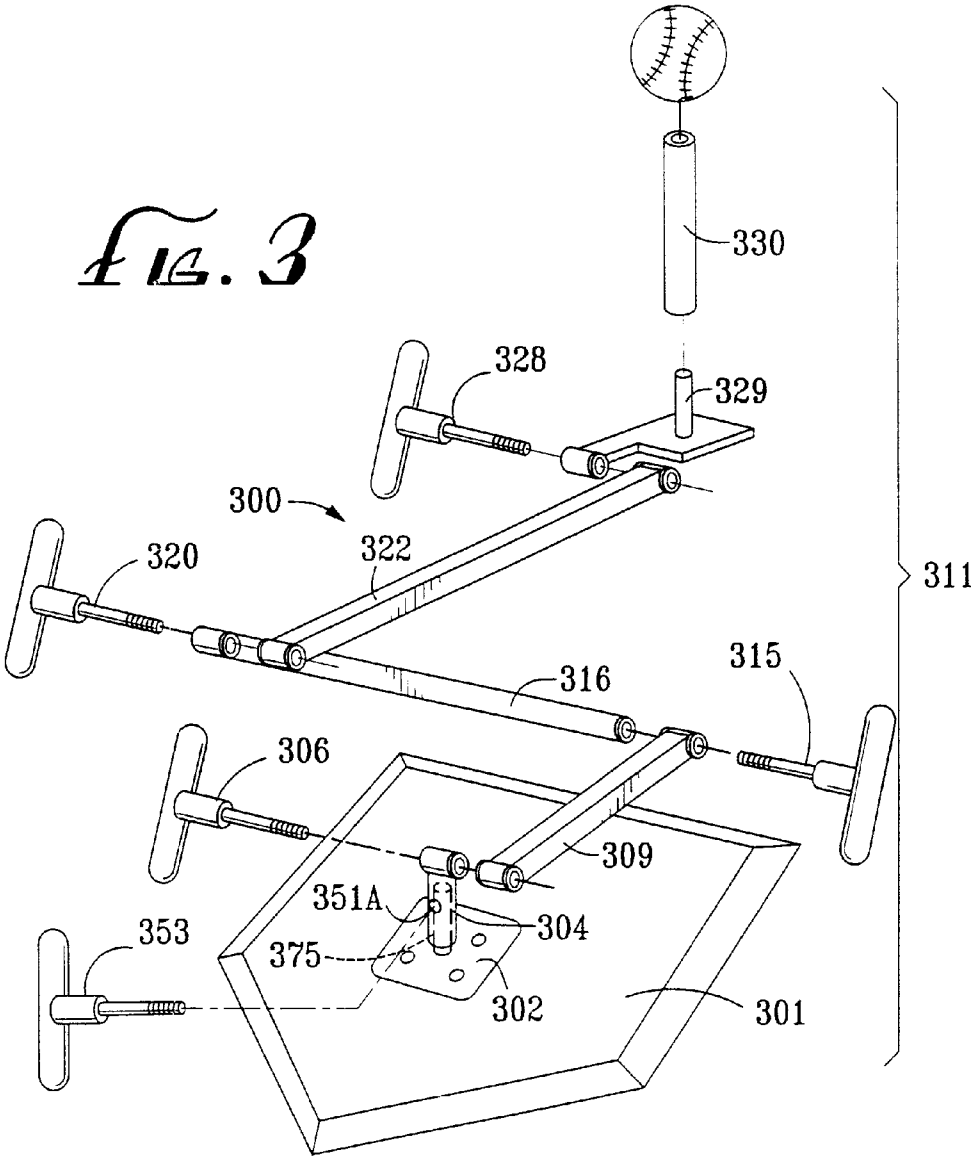
FIG. 3 shows an exploded perspective view of another embodiment of the invention.

Referring now to FIG. 3, there is shown another embodiment of the invention. Ball support device 300 includes a base 301, an articulated support apparatus 311 and a tubular ball holder 330 adapted to be fitted to the shaft 329 at the top of the support. The support apparatus 311 is comprised of a plurality of interconnected arms 309, 316 and 322. A lower tubular shaft 304 is adjustably connected to arm 309. The shaft 304 is, preferably, a close sliding fit with the internal support pin 375 which is attached to mounting plate 302 which is mounted on the support base 301. In a preferred embodiment, support base 301 is configured as a regulation "home plate" for batting practice purposes. In one embodiment, the support base is presented in the size and shape of a "regulation" home plate.

The shaft 304 includes a hole 351A therethrough. The hole 351A cooperates with a T-handle (or similar) threaded fastener 353. That is, fastener 353 is threadedly adjustable with hole 351A whereby a clamping or locking connection can be made to secure shaft 304 to pin 375 when the mechanism has been adjusted, as desired. The degree of adjustment is, of course, vertically infinite.

One end of arm 309 is rotatably mounted to the top end of shaft 304 by means of a suitable pin such as a T-handle 306. The T-handle 306 is secured in place by threadedly engaging the end cap or other suitable locking device at the end of arm 309. Thus, arm 309 rotates around the pivot provided by T-handle 306 and is selectively positioned relative thereto and, ultimately, base 301, by tightening the fastener.

The second end of arm 309 is pivotally joined to one end of arm 316 by a pivot formed by T-handle 315 which passes through openings at the ends of arms 309 and 316.

The locking T-handle 315 is passed through the openings in the ends of arms 309 and 316. The T-handle 315, thus, locks the arm 309 and arm 316 in a selected position.

The second end of arm 316 is pivotally joined to one end of arm 322 by a pivot T-handle 320 which passes through openings at the ends of arms 316 and 322.

The T-handle 320 is selectively passed through the apertures in the ends of arm 322 and 316. The T-handle 321, thus, locks the arm 316 and arm 322 in a selected position.

The second end of arm 322 is pivotally joined to one end of plate 327 by a T-handle pivot bolt 328 which passes through openings at the ends of arm 322 and plate 327.

The T-handle locking pin 328 is passed through the apertures in arm 322 and plate 327 and, thus, locks the arm 322 and plate 327 in a selected position.

Shaft 329 is formed with or joined to the upper surface of plate 327. The ball holder 330 can take any convenient form but is preferably tubular having an internal diameter which is a snug but sliding fit on the upper tubular member 329 and, otherwise, similar to pedestal 130 described supra.

The adjustable fasteners 306, 315, 320 and/or 328 include a friction grip means which may take various forms but one convenient form is shown in the form of a T-handle locking pin 306, 315, 320 or 328. This arrangement provides for an even greater degree of precision in adjustment and positioning.

Thus, there is shown and described a unique design and concept of a ball support device. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A ball support device comprising:

a horizontal base (101);

a vertical support arm (104) held by said horizontal base (101);

a first adjustable arm (109) pivotally held to said vertical support arm (104);

means for holding (151, 160, 102) said first adjustable arm (109) to said horizontal base (101) in plurality of horizontal arcuate angles with respect to said horizontal base (101);

means for holding (107, 108, 109A) said first adjustable arm (109) so that it may be fixed in a plurality of vertical angles with respect to said horizontal base (101);

a second adjustable arm (116) held to said first adjustable arm (109);

means for holding (109B, 112, 114) said second adjustable arm (116) so that it may be fixed in a plurality of vertical angles with respect to said first adjustable arm (109);

a third adjustable arm (122) held to said second adjustable arm (116);

means for holding (116A, 117., 121) said third adjustable arm (122) so that it may be fixed in a plurality of vertical angles with respect to said second adjustable arm (116);

a ball holder (130) pivotally held to said third adjustable arm (122); and means for pivotally securing (122B, 124, 125) said ball holder (130) in a plurality of fixed angular positions with respect to said third adjustable arm (122) and wherein at least one of said means for holding an adjustable arm in a plurality of vertical angles comprises a sprocket having a plurality of openings therethrough affixed to an adjustable arm, a hole in an adjacent adjustable arm and a pin passing through one of the openings in the sprocket and into the hole in said adjacent arm.

2. The ball support device of claim 1 wherein said means for holding (115, 160, 102) said first adjustable arm (109) to said horizontal base (101) in a plurality of horizontal arcuate angles with respect to said horizontal base (101) comprises a sprocket (151) having a plurality of openings (151A) therethrough affixed to said vertical support arm (104), a hole in said base (101) and a pin (160) passing through one of said plurality of openings (151A) and into said hole (101).

3. The ball support device of claim 1 wherein said means for holding (107, 108, 109A) said first adjustable arm (109)

so that it may be fixed in a plurality of vertical angles with respect to said horizontal base (101) comprises a sprocket (108) having a plurality of openings (108A) affixed to one of said vertical arm (104) and said first adjustable arm (109), a hole (109A) in the other of said first adjustable arms (109) and said vertical arm (104), and a pin (107) passing through one of said plurality of openings (108A) and into said hole (109A).

4. The ball support device of claim 1 wherein said means for holding (109B, 112, 114) said second adjustable arm (116) so that it may be fixed in a plurality of vertical angles with respect to said first adjustable arm (109) comprises a sprocket (112) having a plurality of openings (112A) affixed to one of said first (109) and second (116) adjustable arms, a hole (109B) in the other of said second adjustable arms (116) and said first adjustable arm (109), and a pin (114) passing through one of said plurality of openings (112A) and into said hole (109B).

5. The ball support device of claim 1 wherein said means for holding (116A, 117, 121) said third adjustable arm (122) so that it may be fixed in a plurality of vertical angles with respect to said second adjustable arm (116) comprises a sprocket (117) having a plurality of openings (117A) affixed to one of said second (116) and third (122) adjustable arms, a hole (116A) in the other of said third adjustable arms (122) and said second adjustable arm (116), and a pin (121) passing through one of said plurality of openings (117A) and into said hole (116A).

6. The ball support device of claim 1 wherein said means for pivotally securing (122B, 124, 125) said ball holder (130) in a plurality of fixed angular positions with respect to said third adjustable arm (122) comprises a sprocket (125) having a plurality of openings (125A) affixed to one of said third (122) and said ball holder (130), a hole (122B) in the other of said ball holder (130) and said third adjustable arm (122), and a pin (124) passing through one of said plurality of openings (125A) and into said hole (122B).

* * * * *